US011131178B2

(12) United States Patent
Plasencia et al.

(10) Patent No.: US 11,131,178 B2
(45) Date of Patent: Sep. 28, 2021

(54) INJECTION WATER PRE-TREATMENT AND INJECTION SYSTEM AND METHOD

(71) Applicant: Vetco Gray Scandinavia AS, Sandvika (NO)

(72) Inventors: Jose Luis Plasencia, Blommenholm (NO); Keith Birch, Storbritannia (GB)

(73) Assignee: VETCO GRAY SCANDINAVIA AS, Sandvika (NO)

( * ) Notice: Subject to any disclaimer, the term of this patent is extended or adjusted under 35 U.S.C. 154(b) by 574 days.

(21) Appl. No.: 15/561,232

(22) PCT Filed: Mar. 22, 2016

(86) PCT No.: PCT/EP2016/056260
§ 371 (c)(1),
(2) Date: Sep. 25, 2017

(87) PCT Pub. No.: WO2016/150961
PCT Pub. Date: Sep. 29, 2016

(65) Prior Publication Data

US 2018/0058185 A1 Mar. 1, 2018

(30) Foreign Application Priority Data

Mar. 25, 2015 (NO) ..... 20150382

(51) Int. Cl.
*E21B 43/36* (2006.01)
*E21B 43/08* (2006.01)
(Continued)

(52) U.S. Cl.
CPC ..... *E21B 43/36* (2013.01); *E21B 43/04* (2013.01); *E21B 43/08* (2013.01); *E21B 43/20* (2013.01)

(58) Field of Classification Search
CPC ..... E21B 43/04; E21B 43/08; E21B 43/20; E21B 43/36; E03B 33/06–26
See application file for complete search history.

(56) References Cited

U.S. PATENT DOCUMENTS 2,230,001 A * 1/1941 McConnell ..... C09K 8/528 166/268
2,551,434 A 5/1951 Gray et al.
(Continued)

FOREIGN PATENT DOCUMENTS

DE 10 2012 109 535 A1 4/2014
EP 0 747 142 A1 12/1996
(Continued)

OTHER PUBLICATIONS

Machine Translation and Office Action and Search issued in connection with corresponding NO Application No. 20150382 dated Oct. 7, 2015.
(Continued)

*Primary Examiner* — Robert E Fuller
*Assistant Examiner* — Lamia Quaim
(74) *Attorney, Agent, or Firm* — Baker Hughes Patent Organization

(57) ABSTRACT

A system and a method for seawater pre-treatment and injection are disclosed. The seawater pre-treatment and injection system comprises at least one subsea water well connectable to a seawater injection system comprising at least a water injection pump in flow communication with a water injection well, wherein the subsea water well is made as a hole into a groundwater holding strata under the mud-line with a water permeable or non-permeable completion using the seafloor soil for filtration, with an inner tubing connectable to the seawater injection system via a valve.

12 Claims, 3 Drawing Sheets

(51) Int. Cl.
*E21B 43/20* (2006.01)
*E21B 43/04* (2006.01)

(56) References Cited

U.S. PATENT DOCUMENTS

| | | | | | |
|---|---|---|---|---|---|
| 3,729,337 | A * | 4/1973 | Bearden | E21B 43/08 | 210/497.01 |
| 4,319,635 | A * | 3/1982 | Jones | E21B 43/16 | 166/127 |
| 2003/0075507 | A1* | 4/2003 | Munson | B01D 63/06 | 210/649 |
| 2007/0108133 | A1* | 5/2007 | Jones | E21B 7/12 | 210/747.5 |
| 2012/0067820 | A1* | 3/2012 | Henthorne | B01D 61/08 | 210/641 |
| 2013/0168097 | A1 | 7/2013 | Janssen et al. | | |
| 2013/0258092 | A1 | 10/2013 | Hallset | | |
| 2014/0014337 | A1* | 1/2014 | Stringfield | E21B 43/04 | 166/278 |

FOREIGN PATENT DOCUMENTS

| | | | | |
|---|---|---|---|---|
| GB | 2 067 234 | A | 7/1981 | |
| WO | 00/11314 | A1 | 3/2000 | |
| WO | WO-0011314 | A1 * | 3/2000 | E21B 43/40 |
| WO | 2004/106697 | A1 | 12/2004 | |
| WO | 2007/138327 | A1 | 12/2007 | |
| WO | 2007138327 | | 12/2007 | |

OTHER PUBLICATIONS

International Search Report and Written Opinion issued in connection with corresponding PCT Application No. PCT/EP2016/056260 dated Jun. 2, 2016.

International Preliminary Report on Patentability issued in connection with corresponding PCT Application No. PCT/EP2016/056260 dated Sep. 26, 2017.

* cited by examiner

INJECTION WATER PRE-TREATMENT AND INJECTION SYSTEM AND METHOD

FIELD OF THE INVENTION

The Embodiments of the present invention relates generally to arrangements for injection of water into a hydrocarbon carrying formation from which hydrocarbon products can be recovered in hydrocarbon production. Embodiments of the invention particularly relates to a seawater injection system and method including pre-treatment of seawater for injection purposes.

BACKGROUND OF THE INVENTION

Injection of water into hydrocarbon carrying formations is a conventional method to keep up production pressure in the formation, thereby extending the production life of a hydrocarbon well. Quantities in the order of thousands cubic metres of water per day can be injected into the hydrocarbon carrying formation via injection wells that extend down into the permeable formation. When water injection is applied subsea the injection water is usually taken from the sea. Raw seawater however contains salt and other minerals and biological matter which would contaminate the hydrocarbon carrying formation or cause problems in terms of corrosion and clogging of the equipment used, unless these contaminants are removed.

Pre-treatment of seawater for injection purposes may include filtration, sulphate removal and desalination, as well as the addition of chemicals. To meet the desired quantities of treated water a large filter area is required, resulting in bulky and expensive filtration units. Service and replacement of filters in a subsea environment also adds to the costs involved in the production of injection water from raw seawater.

Attempts to avoid a costly pre-treatment of seawater in order to produce water for injection are known in the literature. Some of this prior art involves filtration through natural filter or seabed.

Among them GB-A-2 067 234 discloses an arrangement wherein seawater is passed for filtration through a sandy top layer on the seabed into the open bottom of a vessel that rests on the sand. The water is pumped from the vessel to an injection well that penetrates into the hydrocarbon carrying formation.

Another previous solution is described in the international publication WO 00/11314. A method is disclosed wherein groundwater is extracted and introduced via openings in the wall of an injection well from natural aquifers in the subsoil formation. Pumping equipment inside the injection well is used for injection of the water into a hydrocarbon carrying formation at a different level than the groundwater holding aquifers.

A solution according to the first mentioned prior art suffers from a risk of channels forming through the bed of sand when a continuous flow of water is pumped from the interior of the vessel. Channels through the sand filter affect filtration and may cause contamination of the injection water.

A solution according to the last mentioned prior art suffers from a limited capacity in terms of available quantity of injection water, since each injection well is its own individual supplier of injection water. If the supply of water via the aquifers is low or insufficient the pumping equipment in the subject well is inactivated or operated at reduced capacity, in both cases adding to the costs.

SUMMARY OF THE INVENTION

It is an object of an embodiment of the present invention to provide an improved seawater injection system and method by which the problems and drawbacks connected with earlier solutions and techniques can be avoided.

In one aspect of the present invention the object is met in system for seawater pre-treatment and injection comprising at least one subsea water well (SWW) connectable to a seawater injection system (SWI) comprising at least a water injection pump in flow communication with a water injection well, wherein the subsea water well is made as a hole into a groundwater holding strata under the mudline (ML) with a water permeable or non-permeable completion using the seafloor soil for filtration, with an inner tubing connectable to the seawater injection system via a valve.

In one embodiment the subsea water well comprises an open hole completion into which groundwater rises via the open end of the completion.

In one embodiment the subsea water well comprises a cased hole completion into which groundwater penetrates via a permeable or perforated completion wall.

Filtration and removal of solid material may be via the porous nature of the rock or sand formation surrounding the subsea water well.

An internal multimedia filter may be installed in the subsea water well in order to replace or supplement natural filtration. Variants of this embodiment include a horizontally layered filter housed in an open hole completion, as well as a vertically layered filter housed in a cased hole completion.

In the above mentioned variant the filter media goes from coarse material to fine from the lowermost layer towards the uppermost layer. In the other variant the filter media goes from coarse to fine material from the radially outermost layer to the innermost layer.

In one embodiment the subsea water well comprises a vertically layered filter covering an annulus formed between a permeable completion wall and a perforated inner tube that reaches through the filter.

A variant of this embodiment comprises a gravel pack forming an interface between the inner tube and the multimedia filter. Another variant of this embodiment comprises an inner tube having a perforated wall serving as a strainer, or a separate strainer forming an interface between the inner tube and the multimedia filter.

The vertically layered annulus filter may be extended through the total length of the subsea water well, from the end of completion to the well head.

In case the annulus filter does not fill the subsea water well from lower end to top, a portion of the completion above the annulus filter may be filled with a non-permeable material forming a solid plug that stabilizes the completion and the filter material. The solid plug in the top of the water well may be a plug of cement.

Embodiments of the seawater pre-treatment and injection system comprise a set of subsea water wells connectable to the seawater injection system via a manifold and a common water feed line.

Other embodiments of the seawater pre-treatment and injection system comprise a subsea water well incorporated in a suction anchor and foundation for the seawater injection system.

Still other embodiments of the seawater pre-treatment and injection system comprises a supplementary filter or membrane installed in the water feed line between the subsea water well/wells and the injection pump(s) of the seawater injection system. The supplementary filter or membrane includes fine filtration units in the form of at least one of an ultra-filtration unit, a nano-filtration unit for sulphates removal, and/or a reverse osmosis unit for desalination.

A boosting pump may be arranged in the water supply line between the subsea water well and the supplementary filter or membrane to produce the required feed pressure to the filters/membranes.

A highly integrated embodiment of the seawater pre-treatment and injection system comprises a subsea water well that is incorporated as part of a driven pile, a mud mat, a gravity anchor or a suction anchor.

In correspondence herewith and in another aspect of the present invention a method for seawater pre-treatment and injection comprises extraction of seawater from at least one subsea water well (SWW) that uses the seafloor soil for filtration, and feeding the extracted water to a pump in a seawater injection system (SWI) in flow communication with a water injection well.

In more detail the method comprises the steps of forming a bore in the seafloor soil, inserting a permeable or non-permeable completion in the bore, and arranging an inner tube within the completion and connecting the inner tube to a water injection pump.

In one embodiment the method comprises passing groundwater through a multimedia filter which is arranged about a perforated length of the inner tube inside a permeable well completion.

In a further developed embodiment the method comprises treatment of seawater in fine filtration units arranged between the subsea water well and the water injection pump. This embodiment may further comprise the following steps: supplementary seawater treatment through at least one of ultra-filtration, nano-filtration/sulphates removal, desalination and $CO_2$ removal.

Further details and advantages of embodiments of the present invention will appear from the following detailed description of embodiments.

BRIEF DESCRIPTION OF THE DRAWINGS

Embodiments of the present invention will be described below with reference made to the accompanying schematic drawings. In the drawings.

DETAILED DESCRIPTION OF THE INVENTION

Figure 1:
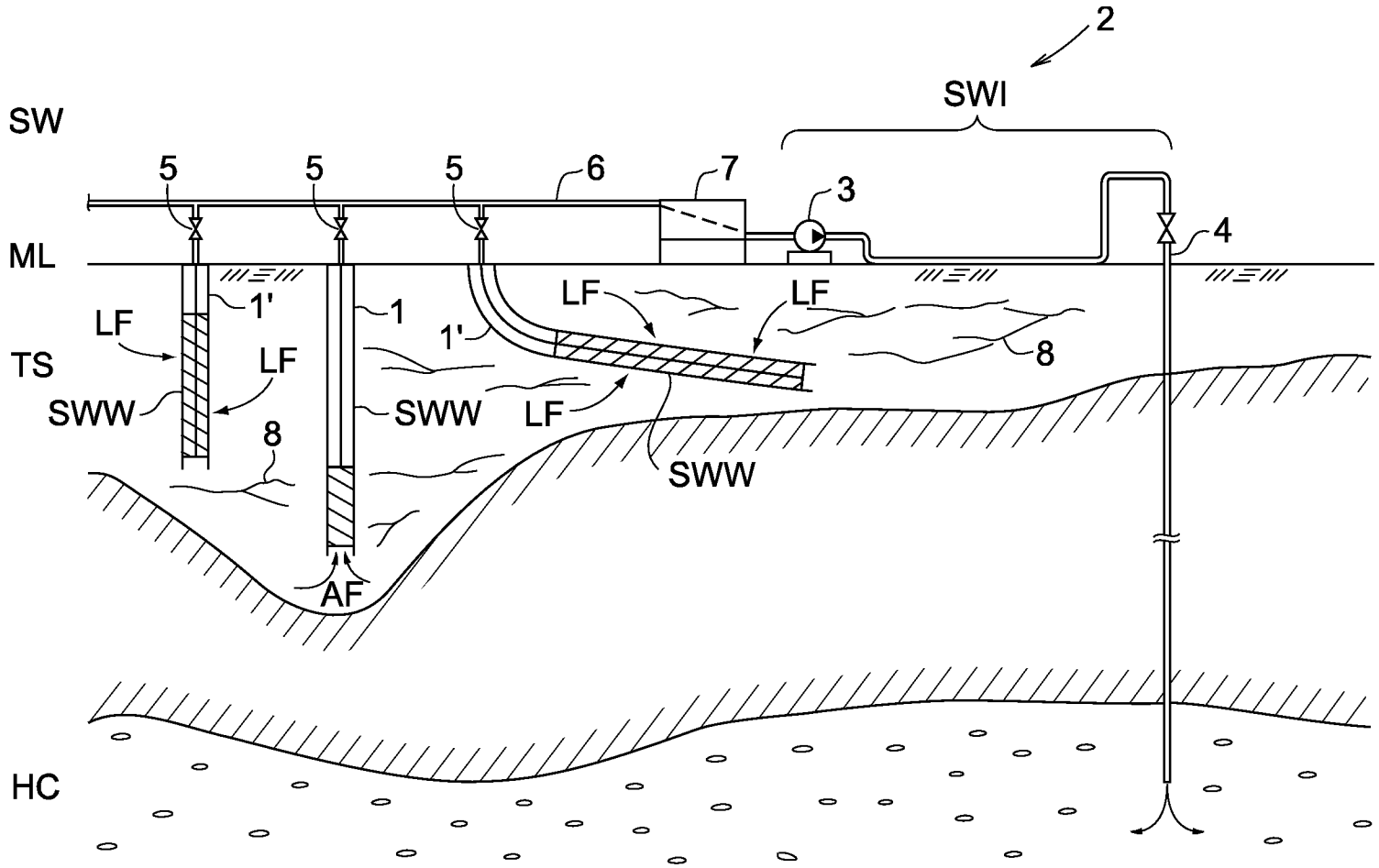
FIG. 1 is an overview of a seawater pre-treatment and injection system installed on the seafloor and in the subsoil structure.

FIG. 1 is a sectional view showing a portion of a seabed under a volume of seawater SW. The seabed structure is separated from the seawater volume through the seafloor or mud-line ML. For the purpose of illustration the underlying subsoil structure is assumed to contain a top strata TS holding groundwater, as well as a deeper lying hydrocarbon holding strata HC. Intermediate layers which contain neither groundwater nor hydrocarbon are in this context of less interest for illustration of an embodiment of the present invention.

With reference to FIG. 1, the seawater pre-treatment and injection system comprises a subsea water well (SWW) 1 or 1' extending into the groundwater holding strata TS. The subsea water wells 1, 1' can be connected to a seawater injection (SWI) system 2 comprising at least a water injection pump 3 and a water injection well 4, the latter extending into the hydrocarbon holding strata HC.

In practise a number of subsea water wells 1 or 1' may be connected to the seawater injection system 2 via valves 5 connecting each subsea water well to the pump 3 via a manifold and feed line 6 for feeding pre-treated seawater to the seawater injection system 2. A supplementary water treatment system 7 may be inserted in the feed of pre-treated seawater from the subsea water wells 1, 1' to the pump, if appropriate. The supplementary system 7 can be equipped with fine filtration filters and membranes such as an ultra-filtration unit, a nano-filtration unit for sulphate removal, a reverse osmosis unit for desalination, or selectively permeable membranes for removal of acid contaminants such as carbon dioxide, e.g. A boosting pump, such as the pump 20 in FIG. 4, may be included in the artificial filtering system 7 to generate the necessary differential pressure over membranes in the filter units as appropriate.

The layout of the seawater pre-treatment and injection system can be varied. Instead of subsea water wells connected in series as illustrated in FIG. 1, e.g., subsea water wells can be arranged in parallel or grouped around the seawater injection system 2, or arranged in a satellite configuration around a central manifold unit from which the subsea water wells share a common pipe that feeds pre-treated seawater to the pump for injection.

The subsea water well 1, 1' extends into the groundwater holding strata TS so as to accumulate water that flows towards the subsea water well via natural voids and aquifers 8 in the structure, thus using the seafloor soil and/or water holding strata for filtration. In this connection it serves to point out that the uppermost layer of the seafloor soil may not always be the best strata for extraction and filtering of water for injection purposes, and that in other realization than the one shown in FIG. 1 a lower laying strata may be better suited for extraction and pre-treatment of seawater for injection purposes.

The subsea water well 1, 1' is formed by making a hole through excavation or evacuation of seabed soil, or by boring into the groundwater holding strata to a length which produces a sufficient water filling ratio of the well. The bore may be vertical or nearly vertical. In case of a shallow strata, or for other structural reasons e.g., the bore may alternatively be given an inclined or mainly horizontal orientation as illustrated in FIG. 1.

The subsea water well 1, 1' is finished through a completion which lines the wall of the bore. The completion can be non-permeable to permit axial flow of water into the well 1 only via an open end of the completion as illustrated by the arrows AF in FIGS. 1 and 2. Alternatively the completion can be permeable to permit water to fill the well 1' in lateral flows as illustrated by the arrows LF in FIGS. 1 and 3.

Figure 2:
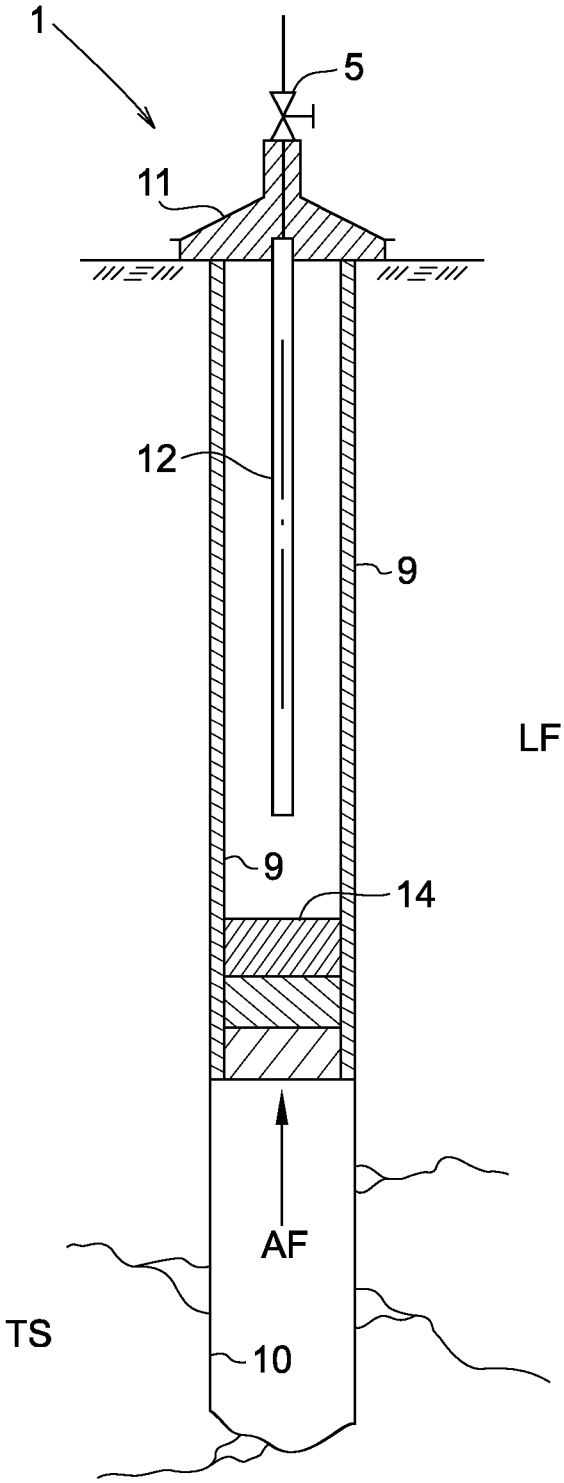
FIG. 2 is a longitudinal section through a subsea water well included in the seawater pre-treatment and injection system of FIG. 1.

With reference to FIG. 2 the subsea water well 1 comprises a non-permeable completion 9 which lines the bore 10. The completion 9 has an open lower end and can thus be regarded as an open hole completion. A wellhead 11 arranged in the upper end of the subsea water well 1 receives the upper end of an inner tube 12 which acts as a riser tube leading accumulated water from inside the completion 9 to a water feed means via a valve 5.

Figure 3:
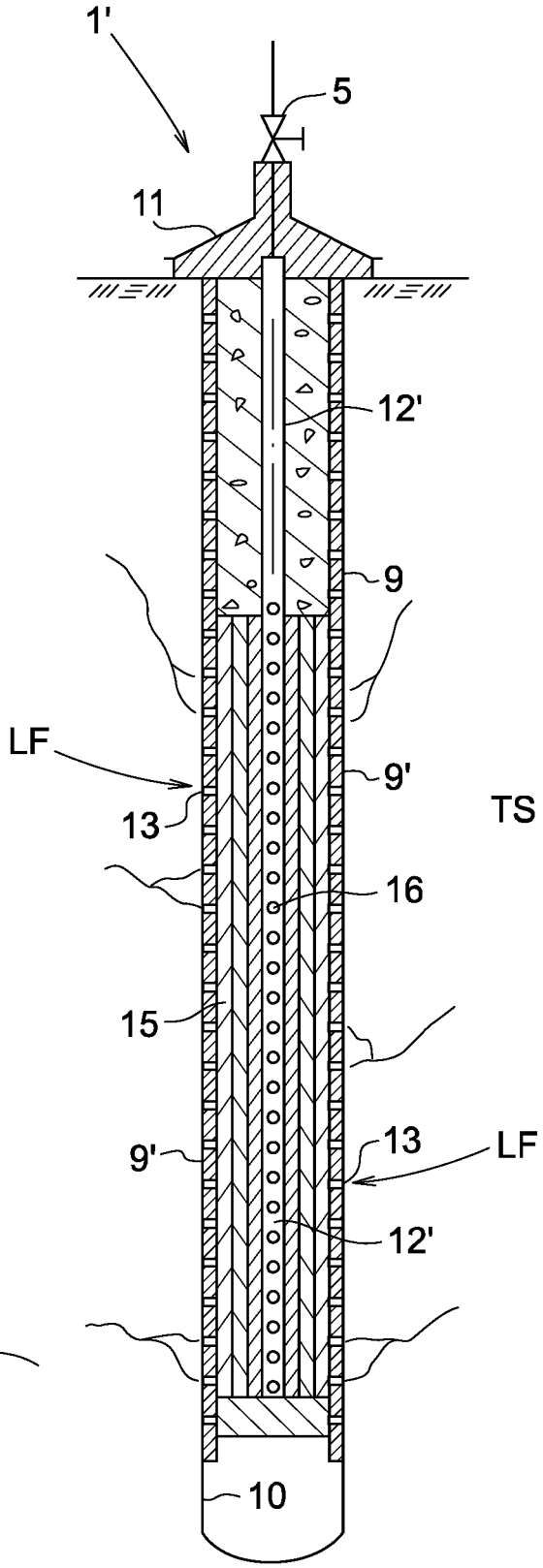
FIG. 3 is a corresponding longitudinal section through an alternative embodiment of the subsea water well.

FIG. 3 illustrates an alternative embodiment 1' of the subsea water well. The subsea water well 1' comprises a permeable completion 9' which lines the bore 10. The completion 9' has a closed lower end and can thus be regarded as a cased hole completion. A wellhead 11 arranged in the upper end of the subsea water well 1 receives the upper end of an inner tube 12' which leads accumulated water from inside the completion 9' to a water feed means via a valve 5. Groundwater enters into the subsea water well 1' through openings 13 formed in the wall of the permeable completion 9'.

In both embodiments the subsea water wells 1 and 1' receive seawater that has passed the subsoil structures for filtration. Depending on the filtering properties of the groundwater holding strata, and overlying structures if appropriate, this natural filtration may itself be sufficient to produce water of a quality that is suitable for injection purposes. In such case supplementary filtration can be omitted.

In other cases, such as where the subsoil structure is loose and/or the extracted water still contains contaminants that need to be removed, artificial filters can be installed inside the wells themselves, i.e. filters that are arranged inside the completions 9 or 9'. If supplementary filtration is needed a multimedia filter is, in one embodiment used for installation in the subsea water well 1 or 1'.

A multimedia filter is usually composed of layers of filter material of different permeability, such that the filtered media, in this case water, passes the multimedia filter through layers of decreasing permeability for particulate matter and bio-organisms. A multimedia filter usually has at least three layers of filtering media with different structures, such as garnet (mesh), sand, and coal.

FIG. 2 shows an embodiment wherein a horizontally layered multimedia filter 14 is arranged near the open end of the non-permeable completion 9, in the subsea water well 1. The filter 14 is composed such that the water passes from coarse material to fine in the flow direction AF.

FIG. 3 shows an embodiment wherein a vertically layered multimedia filter 15 is arranged in an annular space defined between the permeable completion 9' and a perforated inner tube 12', in the subsea water well 1'. The filter 15 is composed such that water passes from coarse material to fine in the flow direction LF. In this embodiment the inner tube 12' extends substantially through the filter 15 with a tube length which is formed with slits or holes 16 for passage of water into the tube. The perforated length of the tube 12' or the whole tube 12' may be formed as a strainer. If appropriate, a vertical layer of gravel (not illustrated) can be arranged at the interface between the perforated tube 12' and the innermost layer of the filter 15.

Figure 4:
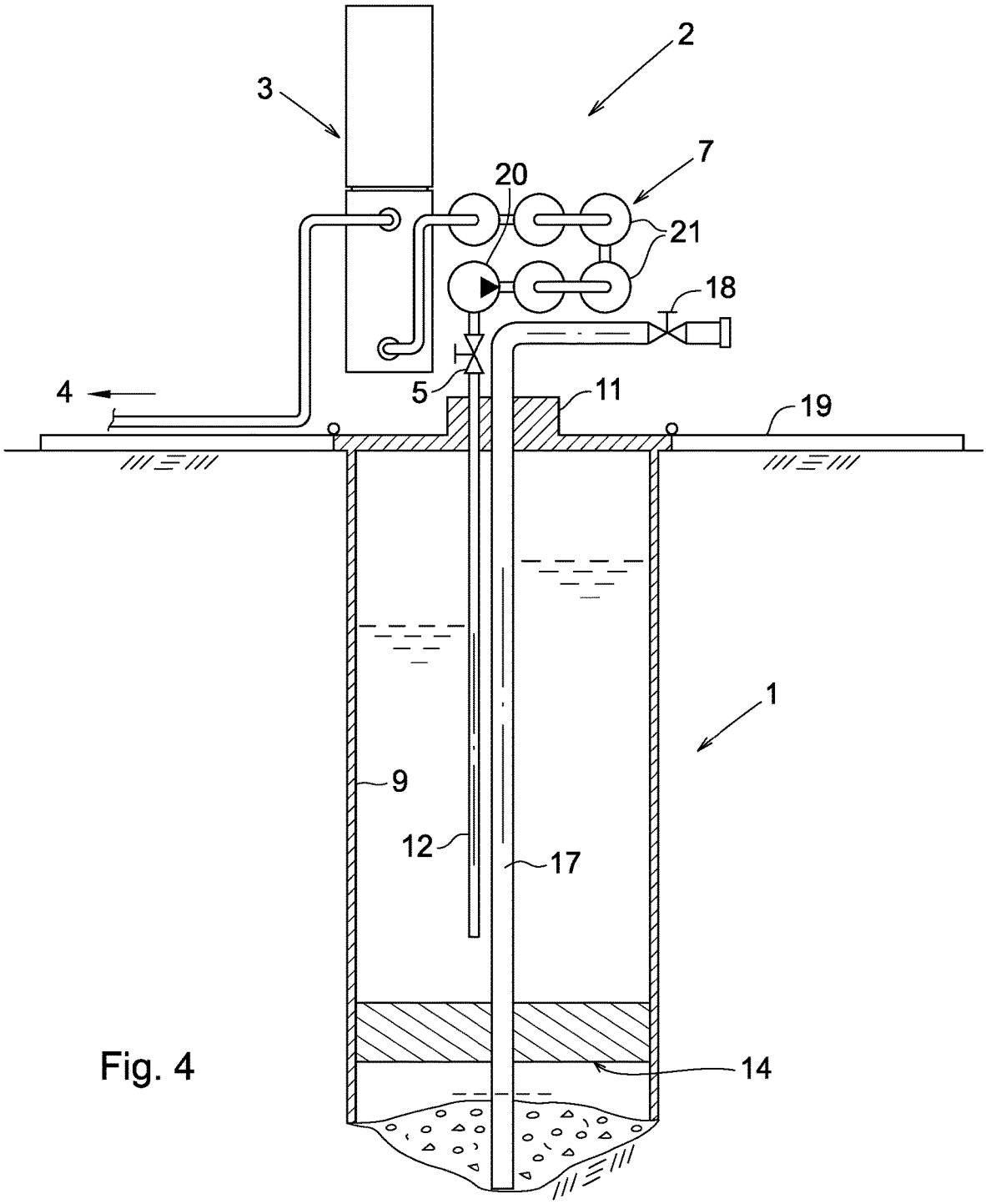
FIG. 4 is a corresponding longitudinal section through a highly integrated embodiment of the seawater pre-treatment and injection system.

A highly integrated embodiment of the seawater pre-treatment and injection system is illustrated in FIG. 4. A subsea water well 1 of the open hole completion variant fulfils the double functions as seawater pre-treatment unit and as an anchor for a seawater injection system 2. To this purpose an inner pipe 17 extends with an open end beyond the lower end of the well completion 9. The inner pipe 17 is via a valve 18 connectable to a pump (not shown) which can be operated for evacuation of the seafloor soil via pipe 17 as the completion 9 is submerged into the seabed upon installation. After the completion 9 has been fully seated and anchored in the seabed, the pipe 17 can be withdrawn (as indicated in FIG. 4 through the broken line transversally intersecting the evacuation pipe 17) to serve for filling a bottom region of the void underneath the pipe with a bed of gravel and/or sand as illustrated. A supplementary filter, such as a multimedia filter 14, can further be arranged within the completion 9 if appropriate. The evacuation pipe 17 and water extraction tube 12 both extends through the wellhead 11. The wellhead 11 can be associated with a mud-mat 19 or other structure that forms a foundation for the seawater injection system 2. In the embodiment shown in FIG. 4 the seawater injection system 2 includes a boosting pump 20 belonging to a complementary seawater pre-treatment system 7 comprising, e.g., a set of semi-permeable membranes 21 for $CO_2$ removal and/or sulphate removal and/or desalination. A subsea motor and pump assembly 3 is arranged for feeding the pre-treated water to a water injection well (as indicated by arrow 4).

Although disclosed in connection with subsea hydrocarbon production it shall be noted that embodiments the present invention may be applied also in connection with water injection in land based hydrocarbon production, where a nearby seabed is available for extraction and pre-treatment of seawater through natural filtration as explained hereinabove. The system and method of embodiments the present invention is particularly useful in areas of high concentration of suspended solids in the seawater, in shallow waters or deep water in which the seabed is unstable or unconsolidated.

Embodiments of the present invention are a new solution for seawater pre-treatment which replaces conventional coarse filtration units and systems and which can operate as a supply of seawater for injection, with or without chemical additive and without the need for backwash of filters, or which can be connected to supplementary filtration and treatment systems such as ultrafiltration units, nano-filtration or reverse osmosis units, e.g. Completion material layers can be used together with strainers if required to meet water quality specifications. One or multiple subsea water wells can feed a seawater injection system, which gives a flexible capacity. Other plausible applications besides those disclosed above and in the drawings include the subsea water well incorporated as part of a driven pile or gravity anchor, e.g. Any such modification which is derivable from the disclosure shall be considered included in the scope of protection as defined by the appended claims.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Aspects from the various embodiments described, as well as other known equivalents for each such aspects, can be mixed and matched by one of ordinary skill in the art to construct additional embodiments and techniques in accordance with principles of this application.

What is claimed is:

1. A system for seawater pre-treatment and injection, the system comprising:

a seawater injection system comprising a water injection pump in flow communication with a water injection well and at least one subsea water well connectable to the subsea water injection system, the at least one subsea water well comprising:

a wellhead;

a water permeable or non-permeable completion extending beneath the wellhead, comprising:

seafloor soil as a filtration medium;

a multimedia filter as an additional filtration medium;

an inner extraction tube extending through the wellhead and connectable to the seawater injection system via a valve, the inner extraction tube extending into the completion to a location above the seafloor soil and the multimedia filter and configured as a riser to extract water from inside the completion; and a withdrawable pipe spaced away from the inner extraction tube and extending through the wellhead and into the seafloor soil, the withdrawable pipe connectable to a pump for evacuating seafloor soil.

2. The system of claim 1, wherein the subsea water well comprises a non-permeable open hole completion into which groundwater rises via an open end of the completion, and a horizontally layered multimedia filter arranged near the open end.

3. The system of claim 1, wherein the subsea water well comprises a cased hole completion into which groundwater penetrates via a permeable or perforated completion wall.

4. The system of claim 1, wherein a set of subsea water wells are connectable to the seawater injection system via a manifold and a water feed line.

5. The system of claim 1, further comprising a supplementary filter or membrane installed in the water feed line between the subsea water well/wells and the seawater injection system.

6. The system of claim 5, wherein the supplementary filter or membrane includes a filtration unit configured to remove sulphates and a reverse osmosis unit for desalination.

7. The system of claim 4, wherein a pump is arranged in a water supply line between the subsea water well and the supplementary filter or membrane.

8. A method for seawater pre-treatment and injection comprising:

forming a bore in seafloor soil;

inserting a permeable or non-permeable completion in the bore;

arranging a withdrawable pipe in the completion, the withdrawable pipe extending into the seafloor soil and connectable to a pump and configured to evacuate seafloor soil;

arranging an inner extraction tube spaced away from the withdrawable pipe within the completion;

as the completion is being inserted, evacuating seafloor soil through a withdrawable pipe extending through the completion and into the seafloor soil;

passing water through the inner extraction tube via layers of decreasing permeability for particulate matter and bio-organisms in a multimedia filter arranged inside the completion and extracting seawater from at least one subsea water well comprising the seafloor soil as a filtration medium;

during extraction, passing the seawater through the seafloor soil; and feeding the extracted seawater to a water injection pump in a seawater injection system in flow communication with a water injection well.

9. The method of claim 8, further comprising treating seawater in fine filtration units arranged between the subsea water well and the water injection pump.

10. The method of claim 9, further comprising supplementary treating seawater to desalinize and remove sulphates and $CO_2$.

11. The method of claim 8, further comprising using the seawater treated for hydrocarbon recovery.

12. The method of claim 8, further comprising arranging a horizontally layered multimedia filter near an open end of a non-permeable completion.

* * * * *